US012612717B2

(12) United States Patent
Wu

(10) Patent No.: US 12,612,717 B2
(45) Date of Patent: Apr. 28, 2026

(54) WOOL-LIKE FABRIC AND WEAVING METHOD THEREOF

(71) Applicant: WUHAN GOLDENFOREST TEXTILE TRADING CO, LTD., Wuhan (CN)

(72) Inventor: Xuelin Wu, Wuhan (CN)

(73) Assignee: WUHAN GOLDENFOREST TEXTILE TRADING CO., LTD., Wuhan (CN)

( * ) Notice: Subject to any disclaimer, the term of this patent is extended or adjusted under 35 U.S.C. 154(b) by 0 days.

(21) Appl. No.: 19/174,945

(22) Filed: Apr. 10, 2025

(65) Prior Publication Data

US 2025/0236995 A1 Jul. 24, 2025

Related U.S. Application Data

(63) Continuation of application No. PCT/CN2024/119282, filed on Sep. 18, 2024.

(30) Foreign Application Priority Data

Jul. 27, 2023 (CN) ..... 202310934731.2

(51) Int. Cl.
*D03D 15/283* (2021.01)
*D03D 13/00* (2006.01)
(Continued)

(52) U.S. Cl.
CPC ..... *D03D 15/283* (2021.01); *D03D 13/008* (2013.01); *D03D 15/49* (2021.01); *D10B 2331/04* (2013.01)

(58) Field of Classification Search
CPC .... D03D 15/283; D03D 13/008; D03D 15/49; D03D 15/40; D03D 15/547; D10B 2331/04; D02G 3/22
See application file for complete search history.

(56) References Cited

U.S. PATENT DOCUMENTS 4,569,883 A * 2/1986 Renjilian ..... D21F 1/30 162/902
5,439,626 A * 8/1995 Bennett ..... D02J 1/22 264/290.5

(Continued)

FOREIGN PATENT DOCUMENTS

CN 109402835 A * 3/2019 ..... D06M 15/263
JP S63105134 A * 5/1988

(Continued)

*Primary Examiner* — Robert H Muromoto, Jr.
(74) *Attorney, Agent, or Firm* — Hemisphere Law, PLLC

(57) ABSTRACT

A wool-like fabric includes warp yarns and weft yarns, the warp yarns include polyester yarns arranged along a warp direction, the weft yarns include semi-dull polyester yarns arranged along a weft direction, and the warp yarns and the weft yarns are woven into the wool-like fabric with a fabric structure. The warp yarns are open-end spun polyester yarns in a range of 6-10 counts, and the semi-dull polyester yarns are the air textured yarns with a specification of 500-700D/192F. A weaving method of the wool-like fabric changes an internal structure of polyester fibers by converting them into hollow fibers, resulting in larger gaps between fibers and a fluffy and woolen effect. Through the above process, ordinary polyester fibers have the effect of full wool fabric, truly allowing consumers to enjoy full wool fabric products at the price of polyester.

10 Claims, 2 Drawing Sheets

(51) Int. Cl.
*D03D 15/49* (2021.01)
*D03D 25/00* (2006.01)

(56) References Cited

U.S. PATENT DOCUMENTS

2005/0136100 A1* 6/2005 Foss ..... A41B 17/00
424/443
2005/0202741 A1* 9/2005 Onodera ..... D03D 15/47
442/194
2017/0340027 A1* 11/2017 Montoya ..... D04B 1/10

FOREIGN PATENT DOCUMENTS

JP H03124857 A * 5/1991
JP H04245985 A * 9/1992

* cited by examiner

WOOL-LIKE FABRIC AND WEAVING METHOD THEREOF

TECHNICAL FIELD

The disclosure relates to the field of weave, and particularly to a wool-like fabric and a weaving method thereof.

BACKGROUND

With the development of society and the continuous improvement of people's material living standards, fabrics are not only required to be beautiful, generous, and gorgeous, but more importantly, environmentally friendly, healthy, and comfortable. Wool fabrics are generally considered high-end fabrics. How to buy wool fabric products at the price of polyester is what many consumers hope to see.

A Chinese patent with publication of CN207828487U discloses a polyester wool-like fabric. The main differences between the disclosure and the Chinese patent with publication of CN207828487U are as follows. Yarn specifications: The disclosure uses 6-10 s air-jet spun polyester yarn and 500-700D/192F semi-dull polyester air-deformed yarn, while the Chinese patent with publication of CN207828487U uses 630D/192F polyester FDY air-deformed yarn. Weaving density: the disclosure has 20-30 warp yarns/cm and 10-20 weft yarns/cm, whereas the Chinese patent with publication of CN207828487U has 30-40 yarns/inch. Fabric structure: the disclosure doesn't specify a particular structure, while the Chinese patent with publication of CN207828487U limits a 45-degree twill. The disclosure utilizes differentiated warp and weft yarn specifications to design fabrics with better fluffiness and fuzz effects. The differentiated design of latitude and longitude density improves the breathability and comfort of the fabric. Unrestricted organizational structure increases product diversity and better meets market demand.

A Chinese patent application with publication of CN109402835A discloses a polyester fiber fancy weaving process. The main differences between the disclosure and the Chinese patent application with publication of CN109402835A are as follows. Process steps: the disclosure includes six steps of warping, sizing, doubling, drawing-in and denting, weaving, and inspecting, while the Chinese patent application with publication of CN109402835A includes five steps of winding, warping, slashing, threading, and weaving. Process parameters: the disclosure specifies sizing temperature (130-140° C.) and time (1-2 minutes), while the Chinese patent application with publication of CN109402835A details slurry composition and winding tension. Equipment selection: the disclosure doesn't limit device models, while the Chinese patent application with publication of CN109402835A limits specific device models for each process. The doubling process in the disclosure combines dried warp threads for neater arrangement, easing subsequent harnessing and ensuring even tension, thus cutting breaks in weaving. The inspecting process in the disclosure checks each piece of finished fabric, weeds out defective ones, and ensures product quality stability and consistency. This prevents sub-par items from entering later processes and aids in spotting and fixing production issues promptly. Not restricting equipment models boosts the process's versatility and scalability, making it more suitable for mass production.

SUMMARY

The purpose of the disclosure is to provide a wool-like fabric and a weaving method thereof, which allows ordinary polyester to have the effect of full wool fabric, truly allowing consumers to enjoy full wool fabric products at the price of polyester.

The technical solutions of the disclosure are as follows.

In an embodiment, a wool-like fabric includes warp yarns and weft yarns, the warp yarns include polyester yarns arranged along a warp direction, the weft yarns include semi-dull polyester yarns arranged along a weft direction, the warp yarns and the weft yarns are woven into the wool-like fabric with a fabric structure, and the semi-dull polyester yarns are air textured yarns.

In an embodiment, a weaving density of the warp yarns is 20-30 ends/cm.

In an embodiment, a weaving density of the weft yarns is 10-20 picks/cm.

In an embodiment, the warp yarns are open-end spun polyester yarns, a number of the open-end spun polyester yarns is in a range of 6-10 counts, and the semi-dull polyester yarns are the air textured yarns with a specification of 500-700 denier (D) per 192 filaments (F).

In an embodiment, a weaving method of the wool-like fabric includes steps as follows.

- S1, Warping: raw yarns are warped on a warping machine. Yarn pieces are drawn from bobbins on a rear creel of the warping machine based on a warp yarn number in a designed process, and the yarn pieces are wound in parallel based on a length and a width in the designed process to form a warp beam containing the warp yarns; the warp beam is well-formed, and during the winding the yarn pieces, uniform tension between yarn roots of the yarn pieces, between the yarn pieces, and between a front end and a back end of the warp beam is ensured.
- S2, Sizing: the warp yarns are passed on the warp beam through a sizing bath to perform sizing to thereby allow sizing liquid to penetrate into the warp yarns, thereby making the warp yarns to withstand stress generated during weaving and reducing a breakage rate of the warp yarns to thereby obtain sized warp yarns, and then the sized warp yarns are heated through a steam jacket to dry the sized warp yarns to obtain dried warp yarns.
- S3, Doubling: the dried warp yarns are doubled by a doubling machine to obtain another warp beam for use.
- S4, Drawing-in and denting: the warp yarns of the another warp beam are threaded based on the fabric structure of the designed process through drop wires, heddles, and reeds to form sheds during the weaving, the sheds are configured to allow shuttles to introduce the weft yarns and weave the wool-like fabric, and a process of threading the warp yarns through the heddles is completed using an automatic drawing-in machine.
- S5, Weaving: the another warp beam and a weft bobbin are installed on a loom, air or water is used as a medium to pull the weft yarns, and the weft yarns are interweaved with the warp yarns based on the fabric structure of the designed process to form the wool-like fabric.
- S6, Inspecting: the wool-like fabric piece is inspected by piece to remove a defective fabric from the wool-like fabric.

In an embodiment, in the S1, a weaving density of the warp yarns is 20-30 ends/cm.

In an embodiment, in the S2, a time for the heating is in a range of 1-2 minutes, and a temperature for the heating is in a range of 130° C.-140° C.

Compared to the related art, the beneficial effects of the disclosure are as follows.

This disclosure changes an internal structure of polyester fibers by converting them into hollow fibers, resulting in larger gaps between fibers and a fluffy and woolen effect. Through the above process, ordinary polyester fibers have the effect of full wool fabric, truly allowing consumers to enjoy full wool fabric products at the price of polyester.

BRIEF DESCRIPTION OF DRAWINGS

In order to provide a clearer explanation of the technical solution of the embodiments of the disclosure, a brief introduction will be given to the attached drawings required for use in the embodiments of the disclosure. It should be understood that the following drawings only illustrate certain embodiments of the disclosure and should not be considered as limiting the scope. For those skilled in the art, other relevant drawings can be obtained based on these drawings without creative labor.

DETAILED DESCRIPTION OF EMBODIMENTS

Below, the technical solution in the embodiments of the disclosure will be described in conjunction with the attached drawings. It should be noted that similar labels and letters represent similar items in the following figures. Therefore, once an item is defined in one figure, it does not need to be further defined and explained in subsequent figures.

The terms "include," "contain," or any other variants thereof are intended to cover non-exclusive inclusion, such that a process, method, article, or apparatus that includes a series of elements includes not only those elements but also other elements not specifically listed, or elements that are inherent to such process, method, article, or apparatus. In the absence of further limitations, an element defined by the phrase "include a . . . " does not preclude the existence of additional identical elements in the process, method, article, or apparatus that includes the element.

The terms "first," "second," and so on are used solely to distinguish one entity or operation from another, and should not be construed as indicating or implying relative importance. They should also not be interpreted as requiring or suggesting any actual relationship or sequence between these entities or operations.

Figure 1:
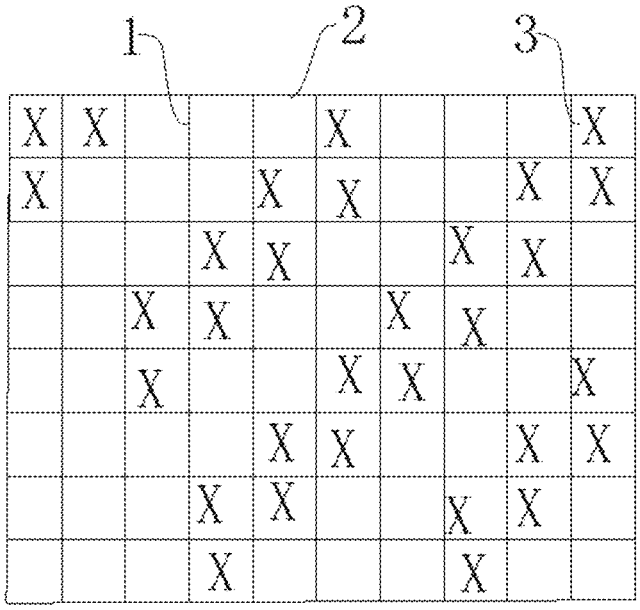
FIG. 1 illustrates a structural diagram of a wool-like fabric of the disclosure.

In an embodiment, a wool-like fabric as shown in FIG. 1, includes warp yarns 1 and weft yarns 2, the warp yarns 1 include polyester yarns arranged along a warp direction, the weft yarns 2 include semi-dull polyester yarns arranged along a weft direction, the warp yarns 1 and the weft yarns 2 are woven into the wool-like fabric 3 with a fabric structure, and the semi-dull polyester yarns are air textured yarns. A number of the open-end spun polyester yarns is in a range of 6-10 counts, and the semi-dull polyester yarns are the air textured yarns with a specification of 500-700 denier (D) per 192 filaments (F).

In an embodiment, a weaving density of the warp yarns is 20-30 strands/cm.

In an embodiment, a weaving density of the weft yarns is 10-20 strands/cm.

Figure 2:
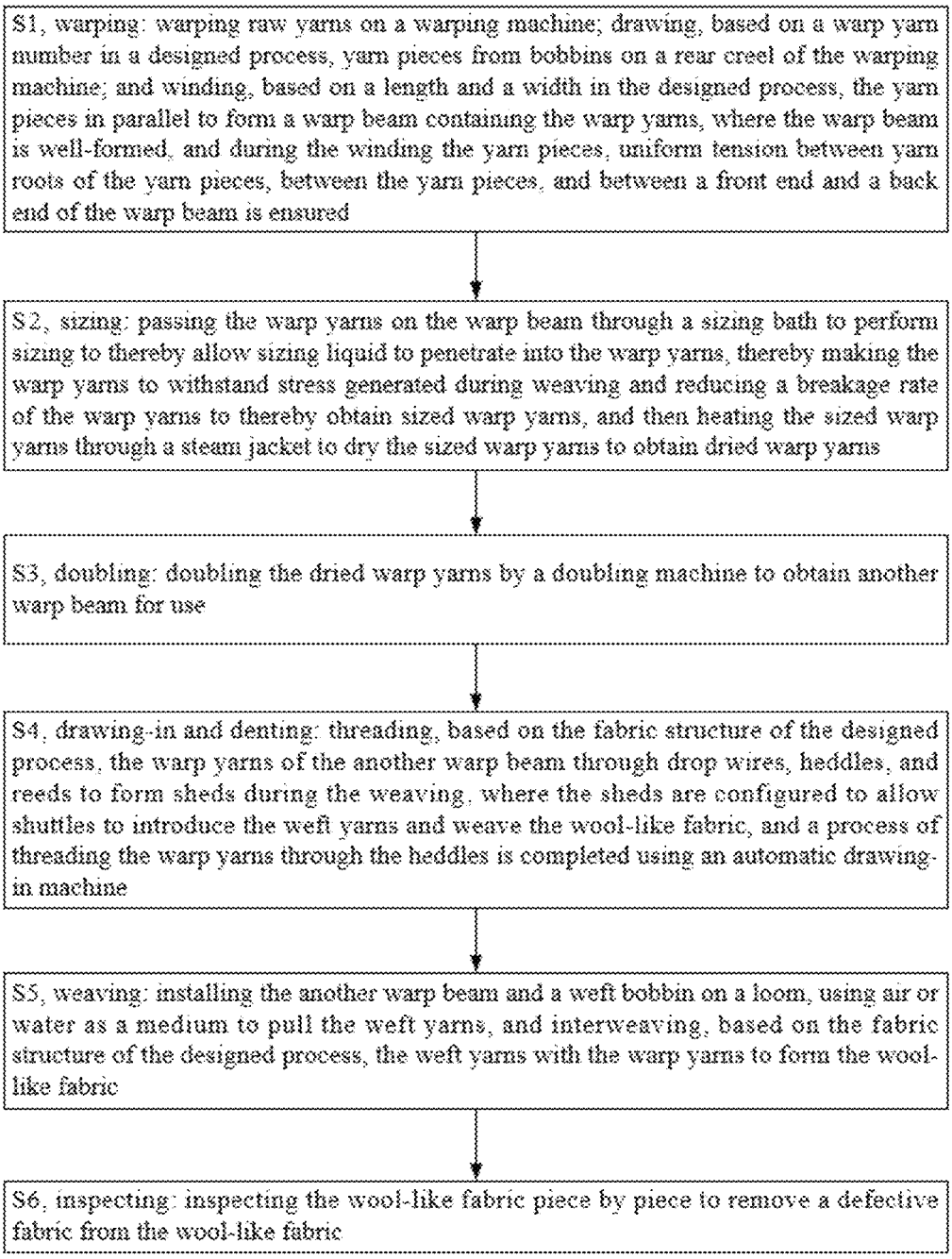
FIG. 2 illustrates a flow chart diagram of a weaving method of the disclosure.

In an embodiment, a weaving method of the wool-like fabric as shown in FIG. 2 includes steps as follows.

S1, Warping: Raw yarns are warped on a warping machine. Yarn pieces are drawn from bobbins on a rear creel of the warping machine based on a warp yarn number in a designed process, and the yarn pieces are wound in parallel based on a length and a width in the designed process to form a warp beam containing the warp yarns. The warp beam is well-formed, and during the winding the yarn pieces, uniform tension between yarn roots of the yarn pieces, between the yarn pieces, and between a front end and a back end of the warp beam is ensured.

S2, Sizing: The warp yarns are passed on the warp beam through a sizing bath to perform sizing to thereby allow sizing liquid to penetrate into the warp yarns, thereby making the warp yarns to withstand stress generated during weaving and reducing a breakage rate of the warp yarns to thereby obtain sized warp yarns, and then the sized warp yarns are heated through a steam jacket to dry the sized warp yarns to obtain dried warp yarns.

S3, Doubling: The dried warp yarns are doubled by a doubling machine to obtain another warp beam for use.

S4, Drawing-in and denting: The warp yarns of the another warp beam are threaded based on the fabric structure of the designed process through drop wires, heddles, and reeds to form sheds during the weaving, the sheds are configured to allow shuttles to introduce the weft yarns and weave the wool-like fabric, and a process of threading the warp yarns through the heddles is completed using an automatic drawing-in machine.

S5, Weaving: The another warp beam and a weft bobbin are installed on a loom, air or water is used as a medium to pull the weft yarns, and the weft yarns are interweaved with the warp yarns based on the fabric structure of the designed process to form the wool-like fabric.

S6, Inspecting: The wool-like fabric piece is inspected by piece to remove a defective fabric from the wool-like fabric.

In an embodiment, in the S1, a weaving density of the warp yarns is 20-30 ends/cm.

In an embodiment, in the S2, a time for the heating is in a range of 1-2 minutes, and a temperature for the heating is in a range of 130° C.-140° C.

In an embodiment, the warping machine, the steam jacket, the doubling machine, the drop wires, the heddles, the reeds, the automatic drawing-in machine, and the loom are common equipment in the related art, and are not limited here.

In a specific embodiment, the weaving method includes steps as follows.

Warping: Raw yarns are warped on a warping machine. Yarn pieces are drawn from bobbins on a rear creel of the warping machine based on a warp yarn number with 23.5 ends/cm in a designed process, and the yarn pieces are wound in parallel based on a length of 1 kilometer and a width of 2.08 meters in the designed process to form a warp beam containing the warp yarns. The warp beam is well-formed, and during the winding the yarn pieces, uniform tension between yarn roots of the yarn pieces, between the yarn pieces, and between a front end and a back end of the warp beam is ensured.

Sizing: The warp yarns are passed on the warp beam through a sizing bath to perform sizing to thereby allow sizing liquid to penetrate into the warp yarns, thereby making the warp yarns to withstand stress generated during weaving and reducing a breakage rate of the warp yarns to thereby obtain sized warp yarns, and then the sized warp yarns are heated through a steam jacket to dry the sized warp yarns to obtain dried warp yarns. A time for the heating is 1 minute, and a temperature for the heating is 130° C.

Doubling: The dried warp yarns are doubled by a doubling machine to obtain another warp beam for use.

Drawing-in and denting: Based on the fabric structure as shown in FIG. 1, the warp yarns of the another warp beam are threaded based on the fabric structure of the designed process through drop wires, heddles, and reeds to form sheds during the weaving, the sheds are configured to allow shuttles to introduce the weft yarns and weave the wool-like fabric, and a process of threading the warp yarns through the heddles is completed using an automatic drawing-in machine. 3528 ends of 8S polyester yarn are threaded as the warp. 3528 ends of polyester filament yarn with a specification of 8S are threaded as the warp yarns.

Weaving: The another warp beam and a weft bobbin are installed on a loom, air or water is used as a medium to pull the weft yarns with a weaving density of 16 picks/cm, and the weft yarns are interweaved with the warp yarns based on the fabric structure of the designed process to form the wool-like fabric.

Inspecting: The wool-like fabric piece is inspected by piece to remove a defective fabric from the wool-like fabric.

By changing polyester fibers into air textured yarns, an internal structure of the fibers is altered, and the gaps between fibers become larger, resulting in a fluffy and woolen effect. Through the above process, ordinary polyester is made to have the effect of full wool fabric, truly allowing consumers to enjoy full wool fabric products at the price of polyester.

The above description is only a part of embodiments in the disclosure and is not intended to limit the scope of protection of the disclosure. For those skilled in the art, the disclosure may have various changes and variations. Any modifications, equivalent substitutions, improvements, etc. made within the spirit and principles of this application shall be included within the scope of protection of disclosure.

What is claimed is:

1. A weaving method of a wool-like fabric, comprising:

S1, warping: warping raw yarns on a warping machine; drawing, based on a warp yarn number in a designed process, yarn pieces from bobbins on a rear creel of the warping machine; and winding, based on a length and a width in the designed process, the yarn pieces in parallel to form a warp beam containing warp yarns, wherein the warp beam is well-formed, and during the winding the yarn pieces, uniform tension between yarn roots of the yarn pieces, between the yarn pieces, and between a front end and a back end of the warp beam is ensured;

S2, sizing: passing the warp yarns on the warp beam through a sizing bath to perform sizing to thereby allow sizing liquid to penetrate into the warp yarns, thereby making the warp yarns to withstand stress generated during weaving and reducing a breakage rate of the warp yarns to thereby obtain sized warp yarns, and then heating the sized warp yarns through a steam jacket to dry the sized warp yarns to obtain dried warp yarns;

S3, doubling: doubling the dried warp yarns by a doubling machine to obtain another warp beam for use;

S4, drawing-in and denting: threading, based on a fabric structure of the designed process, the warp yarns of the another warp beam through drop wires, heddles, and reeds to form sheds during the weaving, wherein the sheds are configured to allow shuttles to introduce weft yarns and weave the wool-like fabric, and a process of threading the warp yarns through the heddles is completed using an automatic drawing-in machine;

S5, weaving: installing the another warp beam and a weft bobbin on a loom, using air or water as a medium to pull the weft yarns, and interweaving, based on the fabric structure of the designed process, the weft yarns with the warp yarns to form the wool-like fabric; and S6, inspecting: inspecting the wool-like fabric piece by piece to remove a defective fabric from the wool-like fabric.

2. The weaving method as claimed in claim 1, wherein in the S1, a weaving density of the warp yarns is 20-30 ends/cm.

3. The weaving method as claimed in claim 1, wherein in the S2, a time for the heating is in a range of 1-2 minutes, and a temperature for the heating is in a range of 130° C.-140° C.

4. The weaving method as claimed in claim 1, wherein a weaving density of the weft yarns is 10-20 picks/cm.

5. The weaving method as claimed in claim 1, wherein the warp yarns comprise polyester yarns, and the warp yarns are open-end spun polyester yarns; the weft yarns comprise semi-dull polyester yarns, and the semi-dull polyester yarns are air textured yarns.

6. The weaving method as claimed in claim 5, wherein a number of the open-end spun polyester yarns is in a range of 6-10 counts, and the semi-dull polyester yarns are the air textured yarns with a specification of 500-700 D/192F.

7. The weaving method as claimed in claim 1, wherein the length in the designed process is 1 kilometer and the width in the designed process is 2.08 meters.

8. The weaving method as claimed in claim 3, wherein in the S2, the time for the heating is 1 minute, and the temperature for the heating is 130° C.

9. The weaving method as claimed in claim 2, wherein the weaving density of the warp yarns is 23.5 ends/cm.

10. The weaving method as claimed in claim 4, wherein the weaving density of the weft yarns is 16 picks/cm.

* * * * *